US006530317B2

(12) United States Patent
Gelbart

(10) Patent No.: US 6,530,317 B2
(45) Date of Patent: Mar. 11, 2003

(54) METHOD TO ENGRAVE SURFACE USING PARTICLE BEAM

(75) Inventor: Daniel Gelbart, Vancouver (CA)

(73) Assignee: Creo Srl, St. James (BB)

( * ) Notice: Subject to any disclaimer, the term of this patent is extended or adjusted under 35 U.S.C. 154(b) by 62 days.

(21) Appl. No.: 09/729,074

(22) Filed: Dec. 5, 2000

(65) Prior Publication Data

US 2002/0066377 A1 Jun. 6, 2002

(51) Int. Cl.[7] ..... B41F 19/02

(52) U.S. Cl. ..... 101/31.1; 219/121.21; 219/121.22; 219/121.19

(58) Field of Search ..... 101/31.1, 32, 3.1, 101/12, 17, 401.1, 150, 170, 467; 347/111, 121, 123, 138, 149, 152; 219/72, 74, 121.12, 121.19, 121.22, 121.21

(56) References Cited

U.S. PATENT DOCUMENTS

| | | | | |
|---|---|---|---|---|
| 3,136,883 A | | 6/1964 | Radtke | |
| 3,246,079 A | | 4/1966 | Teucher | |
| 3,404,254 A | | 10/1968 | Jones | |
| 3,455,239 A | | 7/1969 | Smith | |
| 3,816,698 A | | 6/1974 | Wellendorf et al. | |
| 3,816,699 A | | 6/1974 | Wellendorf et al. | |
| 4,028,523 A | | 6/1977 | Anderl et al. | |
| 4,057,258 A | | 11/1977 | Ernst et al. | |
| 4,071,731 A | | 1/1978 | Baar | |
| 4,252,353 A | | 2/1981 | Rai et al. | |
| 4,268,597 A | * | 5/1981 | Klavan et al. | 430/102 |
| 4,317,982 A | | 3/1982 | Taudt et al. | |
| 4,393,295 A | | 7/1983 | Beisswenger et al. | |
| 4,515,375 A | * | 5/1985 | Bleckmann et al. | 277/1 |
| 4,733,046 A | | 3/1988 | Angelbeck et al. | |
| 4,733,091 A | * | 3/1988 | Robinson et al. | 250/492.2 |
| 4,827,127 A | * | 5/1989 | Todokoro | 250/310 |
| 5,324,912 A | | 6/1994 | Boppel et al. | |
| 5,438,179 A | | 8/1995 | Boppel et al. | |
| 5,477,023 A | * | 12/1995 | Schneider et al. | 219/121.68 |
| 6,309,799 B1 | * | 10/2001 | Ruckl | 430/306 |
| 6,433,890 B1 | * | 8/2002 | Beckett et al. | 358/1.9 |

OTHER PUBLICATIONS

Ferrofluidics Corporation. Selected pages from corporate website, accessed Nov. 27, 2000.

Wentgate Dynaweld Inc. Advertising website hosted by the Thomas Register on the Internet, accessed Nov. 27, 2000.

* cited by examiner

*Primary Examiner*—Andrew H. Hirshfeld
*Assistant Examiner*—Darius N. Cone

(57) ABSTRACT

In accordance with the present invention a gravure cylinder is engraved by means of an electron beam which is modulated to create upon the surface of the gravure cylinder the desired gravure cells, the required vacuum being maintained only in a limited volume around the electron gun by the use of a conformal high vacuum ferrofluid seal that is substantially free of mechanical friction.

22 Claims, 2 Drawing Sheets

METHOD TO ENGRAVE SURFACE USING PARTICLE BEAM

FIELD OF THE INVENTION

The present invention pertains to the general field of printing and in particular to the engraving of gravure cylinders.

BACKGROUND OF THE INVENTION

Gravure is one of the main processes employed by the printing industry, with billions of copies of gravure-printed magazines being produced annually. Gravure printing is also employed extensively in the packaging industry.

In the gravure printing process ink is transferred to the medium, typically paper or plastic, via metal printing cylinders that are normally several meters long. The gravure process transfers ink from small wells or cells that are engraved into the copper- and chrome-plated surface of these cylinders, while the cylinders are mounted on the printing press. Each cylinder is rotated through a fountain of ink and the ink is wiped from those areas of the cylinder-surface that have no gravure-impressions by a doctor blade. The inverted pyramid-shape or cup-like shape of each gravure-cell holds the ink in place as the cylinder turns past the doctor blade.

The cylinder cells are the most important part of the gravure printing process. The quality of the printed image is dependent on the size, shape and depth of the cells.

The width of the cell refers to how wide the cell is in the cross direction. The depth is how far below the surface the cell extends. The wall is the barrier between the cells and is used to support the doctor blade. The top of the cell wall and the un-engraved areas of the cylinder are commonly referred to as the land. The opening is described by the shape and cross sectional area. The bottom of the cell can be flat, or nearly flat, or inverted pyramid shaped.

Various techniques are employed to engrave gravure-cylinders. Cells can be chemically etched or electromechanically engraved. More recently laser-engraving has become available. Yet more recently electron-beam-engraving has been evaluated with a view to its use in gravure engraving.

Different methods exist to chemically etch gravure cylinders. The traditional chemical etching method, employing carbon tissue, leads to a cylinder that has cells of equal area, but differing depths. The subsequently developed direct transfer technique produces the opposite relationship in that the cells all have the same depth of the order of 20 to 25 microns, but their areas differ. Cell-wall widths are typically of the order of 5–10 microns and etching times are of the order of 3 to 5 minutes.

Electromechanical engraving is the most common method of cylinder imaging today and is a direct result of advances in electronic technology.

Once the image information has been scanned and digitized it is processed for the engraving section of the machine. The objective of the engraving process is to produce cells which, when printed, will duplicate the density of the desired image. The very small volume of ink must be controlled within the engraved cell volume.

The tool used for electromechanical engraving is a diamond stylus of triangular cross section that engraves an inverted pyramid. The digital processed image information is converted to an electronic vibration that produces a mechanical motion in the diamond stylus. The darker the desired image the deeper the diamond penetrates into the copper. The large cell will carry more ink and produce more density. Conversely, if a light tone is desired, the diamond makes only a slight cut into the copper. The cells are cut at a typical rate of 8000 per second, but systems have been demonstrated engraving up to 20,000 cells per second. After engraving the cylinder is plated with chrome for durability.

There are four basic cell structures formed during electromechanical engraving. They are compressed, elongated, normal and fine. By using these alternately shaped cells, color process printing becomes possible. The size and position of the cells begin to form a line screen image. This screening effect allows for the successful combination of the four process colors.

Due to the high cost of the diamond stylus and the processing the finished cylinder is a very expensive and significant part of the gravure process. There has therefore been considerable effort devoted to developing lower cost routes to gravure engraving.

Information technology has transformed printing to a very great extent. Since design and layout are now normally conducted electronically, the manufacturers of printing equipment are developing new systems that are fully compatible with the speed, precision, and sustained accuracy of computers. The general aim is to shorten processing times without deviating from the rigorous quality standards demanded by the end users. The engraving of the gravure cylinder and its subsequent plating with chromium for protection, is a time consuming task, however, as a single head precision mechanical engraver takes at least ten hours to complete a drum. There was and is a clear market demand for quicker alternatives.

In response to the aforementioned challenge, there has been much attention devoted to the idea of replacing the diamond styli with an energy beam. Concepts for gravure engraving using electron beams were proposed in the 1960's. During the decade of the 1980's there was considerable experimentation with both laser and electron beam engraving, but it proved unsatisfactory with the technology then at hand.

In the early 1990s, more progress was made in the field of indirect laser gravure. The copper roller received an even coating of a substance that was removed by a beam from a modest 60 W laser. The actual inkwells were then created in parallel by chemically etching the roller before it was chromium plated. Though this indirect laser engraving produced cells that were hemispherical, the optimal shape for ink-retention, it was not ideal in its application because the etching stage could not be fully controlled at a reasonable cost. During the decade of the 1990's there were further developments in which the direct laser-engraving of the cylinder was addressed using 400 Watt lasers. This approach succeeded in generating up to 140,000 inkwells per second, with the walls between the cells being just a few microns. It took less than 15 minutes to complete a square meter of drum surface engraving. Here again, the hemispherical well-shape allowed the wells to be only two-thirds of the depth normally required with diamond-stylus engraving.

Against this background, there is therefore scope for addressing the use of electron beams as a means of engraving the gravure cylinder. Electron beam systems of practical power levels can only function within vacuum. Previous effort within industry consisted of encasing the entire system in vacuum. This leads to grave practical problems and increases cost.

Alternative concepts revolved around evacuating only the minimum of volume surrounding the electron gun and the area of the gravure cylinder to be engraved. However, these approaches involved using various mechanical seals to maintain the vacuum while the gravure cylinder rotates against the seals. This generic solution suffers from the fact that no mechanical sliding seal can conform well enough to the surface of the engraved gravure cylinder to maintain adequate vacuum for the high-energy electron beam, particularly if the seal is directly to atmosphere.

Electron-permeable membranes have been suggested, but these mechanically sensitive structures, while very useful in laboratory circumstances and for low-intensity beams, are ill suited to the industrial conditions that pertain to gravure printing. They also are not adequately permeable to larger charged particles.

The problem of maintaining vacuum as the engraving process approaches the ends of the gravure cylinder has also been previously addressed via various mechanical arrangements that involve fitting extensions to the gravure cylinder.

BRIEF SUMMARY OF THE INVENTION

In accordance with the present invention a gravure cylinder is engraved by means of an electron beam which is modulated to create upon the surface of the gravure cylinder the desired gravure cells, the required vacuum being maintained only in a limited volume around the electron gun by the use of a conformal high vacuum ferrofluid seal that is substantially free of mechanical friction.

DETAILED DESCRIPTION OF THE PREFERRED EMBODIMENT

Figure 1:
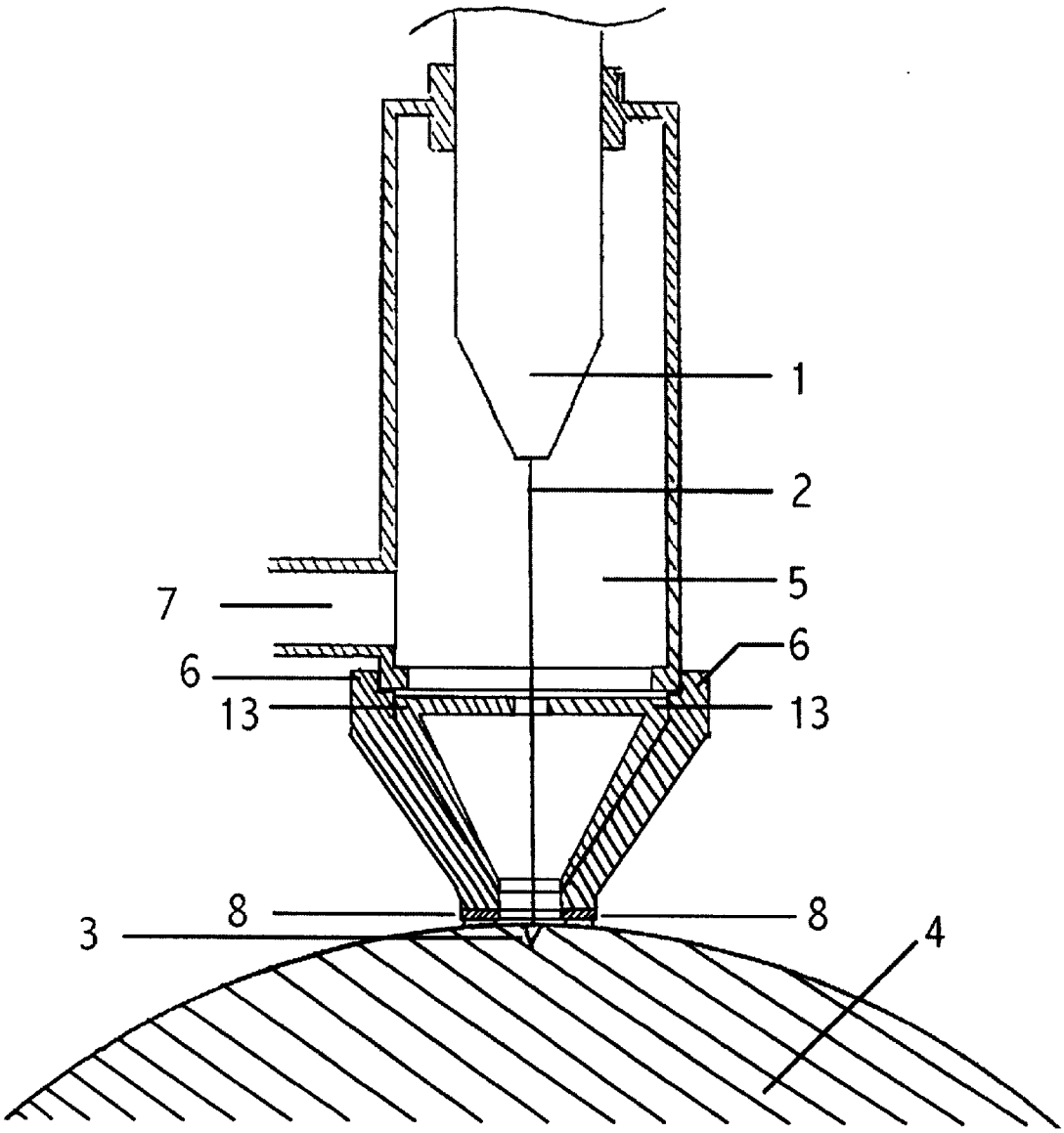
FIG. 1 depicts the arrangement for maintaining a high vacuum seal between an electron-gun assembly and a gravure cylinder while the gravure cylinder rotates against the seal.

FIG. 1 depicts the essence of the preferred embodiment. An electron gun 1 emits a high power electron beam 2 to engrave a gravure cell 3 on a gravure cylinder 4 rotating about its cylindrical axis. To the extent that electron beam 2 requires high vacuum, electron beam chamber 5 is evacuated by a high vacuum pump arrangement (not shown) via vacuum port 7. In order to ensure that this vacuum is maintained, a high vacuum seal is established between the nosepiece 6 of the electron beam chamber and the surface of gravure cylinder 4 by means of ferrofluid seal 8. As gravure cylinder 4 rotates, electron gun 1 modulates electron beam 2 to obtain the desired dimensions for gravure cell 3. Means and mechanisms for such modulation have been discussed in the prior art and will not be here addressed as part of this application for letters patent.

Ferrofluids are fluids that have strong ferromagnetic properties. In the presence of a magnet they assume a shape following the magnetic field lines. The principles of operation of ferrofluid seals are well established in the prior art and many different designs exist, mostly for rotary vacuum feedthroughs or loudspeakers, both generic items consisting of mechanical parts that are usually cylindrically concentric or annular in shape. An example of a company that supplies both ferrofluids and vacuum sealing systems incorporating ferrofluids is Ferrofluidics Corporation of Nashua, N.H. The details of the functioning of ferrofluids and their application in vacuum seals will therefore not be dwelt upon here. The intent of the present invention is to adapt the known properties of ferrofluid seals to the unique challenges posed by the engraving of gravure cylinders with corpuscular beams traversing vacuum to create a solution to problems of some standing over time.

Typically a single stage of a ferrofluid seal can maintain a pressure differential of approximately 0.2 atmospheres. In the preferred embodiment of the invention, multiple ferrofluid seal stages are therefore employed in order to provide a ferrofluid seal 8 that can maintain adequate vacuum for the electron gun 1 whilst allowing the gravure cylinder 4 to rotate substantially without mechanical friction with nosepiece 6 while nosepiece 6 is pushed against it.

Figure 2A:
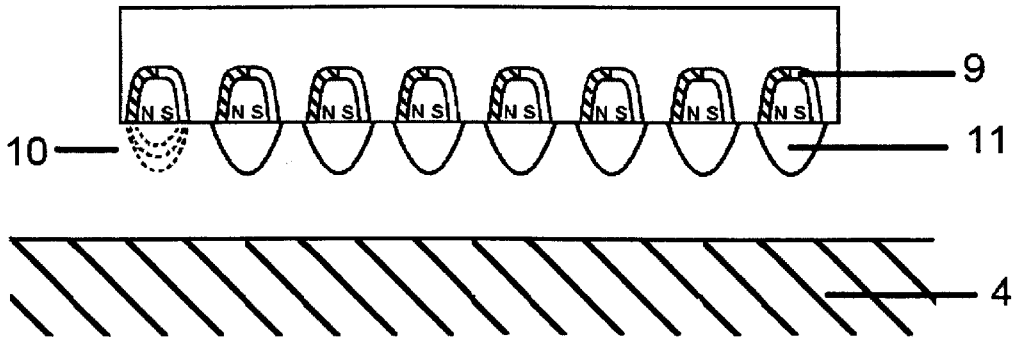
FIG. 2*a* and FIG. 2*b* show schematics of ferrofluid seal behaviour and represent a close-up view of part of FIG. 1.
Figure 2B:
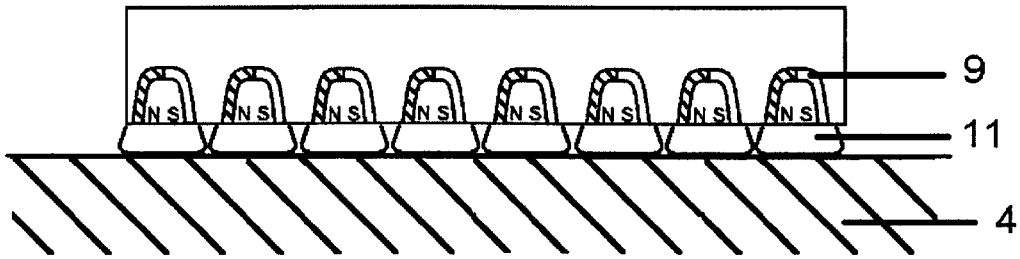

In FIG. 2*a* and FIG. 2*b* this situation is depicted schematically. FIG. 2*a* shows a concept schematic of ferrofluid seal 8 of FIG. 1, having eight magnets 9, with the ferrofluid seal being some distance away from the surface of gravure cylinder 4. The magnetic field lines 10 of one of these magnets are shown schematically, depicted by broken lines. The ferrofluid liquid droplets 11 are depicted on the remaining seven magnets and are schematically shown to direct themselves along the magnetic field lines.

In FIG. 2*b*, the arrangement of FIG. 2*a* is brought into contact with gravure cylinder 4 and the ferrofluid droplets are flattened by the mechanical force on the seal. The droplets nevertheless retain their integrity and maintain thereby a vacuum seal.

Referring again to FIG. 1, nosepiece 6 approximately matches the curvature of the cylindrical surface of gravure cylinder 4. To the extent that the electron beam is affected by magnetic fields, care is taken to ensure that the magnetic field produced by the circularly shaped ferrofluid seal 8 is radially symmetric, thereby ensuring that that electron beam will not experience lateral deflective forces. To further ensure that the field of the ferrofluid seal 8 does not affect the electron beam 2, nosepiece 6 is manufactured from a magnetically shielding material, such as Mu-metal.

In order to ensure that no materials that are removed by the electron beam from the surface of the gravure cylinder sputter onto the sensitive subcomponents (not shown) of the electron gun 1, shield 13 may be fitted within nosepiece 6. The positioning of vacuum port 7 behind the shield ensures that there is no line of sight between the gravure cell 3 and the vacuum port. The shield 13 may therefore function as disposable deposition plate and may be replaced when too much copper or other materials have deposited on it. Shield 13 is manufactured from magnetically shielding material to further shield the electron beam 2 from the influence of ferrofluid seal 8.

To the extent that gravure cylinders of different radii may be employed, nosepiece 6 is made intentionally small in cross-section. This ensures that as small an arc as possible of the gravure cylinder 3 is subtended by nosepiece 6 at any time. This approach, combined with the inherent magnetohydrodynamic behaviour of the ferrofluid, ensures that, in the case where a gravure cylinder 4 of smaller radius is employed, the ferrofluid will simply close the resulting larger gap between nosepiece 6 and the surface of gravure cylinder 4. This choice of a nosepiece 6 with small cross-section therefore results in a method that allows a single arrangement to address the engraving of many different sizes of gravure cylinders 4. The narrow cross-section of nosepiece 6 also allows for the engraving of gravure cylinders very close to their edges, thereby removing the requirement for cumbersome mechanical extensions described in the prior art. In the prior art these were proposed in order to address situations where vacuum was lost as the edge of the gravure cylinder was approached, the loss of vacuum being inherently due to the use of mechanical seals.

Gravure cylinders are typically copper-plated. Since copper has very little magnetic property, this plating layer has little effect on the magnetic field structure generated by the ferrofluid seal 8. If it is desired to engrave a cylinder after plating, the thin chrome layer does not significantly affect the magnetic field. Gravure sleeves are also known. These sleeves may be fitted over an inner cylinder and the entire gravure process is performed on the surface of the sleeve. Gravure sleeves can be made of a polymeric material or of metal, such as chrome, nickel or any hard alloy.

In the preferred embodiment, the gravure cylinder may be a cylinder coated with copper, which, in turn, may be coated with chromium, as is traditionally the case. Alternatively, the surface being engraved may be that of a sleeve fitted over the cylinder. This sleeve may be of a single material or may consist of different layers of materials.

The use of high-energy particle beams also makes possible the direct gravure of a harder surface layer, such a chromium, without having to employ copper, as is necessary in the case of diamond gravure. In the preferred embodiment the surface of the gravure cylinder 4, may therefore also be chromium or another durable material. An alternative to metal is a ceramic coating that can be applied by plasma spraying.

The preferred embodiment employs an electron beam with a power of 5–20 kW. Electron beams are well-known for cutting and welding and no further details of electron gun systems are discussed herewith. Examples of companies that supply such systems are Wentgate Dynaweld of Agawam, Mass. and Ferrofluidics Corporation of Nashua, N.H.

In a second embodiment of the invention, the nosepiece 6 has a larger diameter. In this case curvature mismatches between nosepiece 6 and the surface of gravure cylinder 4 become more significant. In this case it is no longer possible to rely on the ferrofluid seal to automatically close the gap between nosepiece 6 and the surface of gravure cylinder 4. To the extent that gravure cylinders of different radii may be employed, nosepiece 6 is detached and replaced by a nosepiece of curvature matching the surface curvature of the gravure cylinder selected.

In another embodiment of the invention the surface being engraved is flat and the sealing surface of the electron beam chamber is correspondingly flat. In this embodiment a ferrofluid seal with a flat face will provide a frictionless conformal seal to this surface. This situation pertains with flat printing plates. The materials employed in the plate can be magnetic or non-magnetic.

The term conformal seal is to be understood here as a seal following the variations and indentations and perturbations of the surface to which the seal conforms; this being in contrast to any mechanical seals. The surface of the seal is therefore at any moment in time an exact negative casting of the surface to which it conforms. The term printing forme is understood here to represent all printing plates, cylinders and other impression tools employed to effect printing.

The term corpuscular beam is herein understood to be a beam of charged or uncharged particles of molecular, atomic or sub-atomic nature.

What is claimed is:

1. A method for engraving a surface of an object, the method comprising:

providing a chamber having an open end adjacent to and spaced apart from a surface of an object to be engraved;

sealing the chamber to the surface by way of a ferro-fluid seal surrounding the open end;

evacuating the chamber; and, engraving the surface by generating a corpuscular beam within the chamber and directing the corpuscular beam onto the surface to engrave the surface while moving the surface relative to the chamber;

wherein the seal employs any number of individual masses of ferrofluid.

2. A method as in claim 1 wherein the object is magnetically permeable at the surface.

3. A method as in claim 1 wherein the surface is the surface of a printing forme.

4. A method as in claim 1 comprising modulating said beam with data.

5. A method as in claim 1 wherein the object is a gravure cylinder.

6. A method as in claim 1 wherein the corpuscular beam is a charged particle beam.

7. A method as in claim 1 wherein said corpuscular beam is an electron beam.

8. A method as in claim 1 comprising providing replaceable members in the chamber proximate to the surface and collecting materials removed from the surface on the replaceable members.

9. The method of claim 1 wherein sealing the chamber to the surface comprises sealing at least a portion of the ferro-fluid seal to an engraved portion of the surface.

10. The method of claim 1 wherein the corpuscular beam comprises a beam of uncharged particles.

11. The method of claim 1 wherein the surface comprises a material having a hardness greater than a hardness of copper.

12. The method of claim 1 wherein the surface comprises chromium.

13. The method of claim 1 wherein the surface comprises a ceramic coating.

14. the method of claim 13 comprising applying the ceramic coating by plasma spraying.

15. The method of claim 7 wherein the electron beam has a power in the range of 5 kW to 20 kW.

16. The method of claim 9 wherein the surface is a cylindrical surface.

17. The method of claim 16 wherein the open end has a curvature matching a curvature of the cylindrical surface.

18. The method of claim 1 wherein sealing the chamber to the surface by way of the ferro-fluid seal comprises sealing the chamber to the surface by providing multiple ferro-fluid seal stages extending around the open end of the chamber.

19. The method of claim 1 wherein the ferro-fluid seal is radially symmetrical.

20. The method of claim 16 wherein the ferro-fluid seal has a diameter much smaller than a radius of curvature of the cylindrical surface.

21. Apparatus for engraving a surface of an object, the apparatus comprising:

a chamber having an open end positionable adjacent to and spaced apart from a surface of an object to be engraved;

a ferrofluid seal surrounding the open end;

a vacuum system connected to evacuate the chamber; and, an apparatus within the chamber for directing a corpuscular beam-through the open end of the chamber.

22. The apparatus of claim 21 adapted for etching a cylindrical surface wherein the ferrofluid seal is curved to match a radius of curvature of the cylindrical surface.

* * * * *